United States Patent [19]

Hsu

[11] Patent Number: 4,603,727

[45] Date of Patent: Aug. 5, 1986

[54] FLEXIBLE PERMEABLE VALVE FOR MELT SPINNING PROCESS

[75] Inventor: Shih C. Hsu, Wellesley, Mass.

[73] Assignee: GTE Laboratories Incorporated, Waltham, Mass.

[21] Appl. No.: 623,661

[22] Filed: Jun. 22, 1984

[51] Int. Cl.[4] ..... B22D 39/00; B22D 41/10

[52] U.S. Cl. ..... 164/133; 164/437; 164/337; 222/600; 222/602; 222/603

[58] Field of Search ..... 164/133, 463, 423, 437, 164/337; 222/597, 600, 602, 603

[56] References Cited

U.S. PATENT DOCUMENTS

| | | | |
|---|---|---|---|
| 3,964,535 | 6/1976 | Bedell et al. | 164/423 X |
| 4,260,007 | 4/1981 | Wellslager et al. | 164/463 |
| 4,282,921 | 8/1981 | Liebermann | 164/463 |

FOREIGN PATENT DOCUMENTS

| | | | |
|---|---|---|---|
| 834234 | 5/1960 | United Kingdom | 222/603 |

*Primary Examiner*—Nicholas P. Godici
*Assistant Examiner*—Samuel M. Heinrich
*Attorney, Agent, or Firm*—Ivan L. Ericson

[57] ABSTRACT

Chill-cast metal foil is produced by an apparatus having a flexible gas permeable valve which provides a means for retaining the molten metal prior to processing it into a chill-cast metal foil and simultaneously providing a gas purging of the reservoir and the orifice in the reservoir to prevent formation of detrimental oxides of the molten metal by the exposure of the molten metal to air or oxygen containing atmosphere.

A method for producing the chill-cast foil is also described.

6 Claims, 2 Drawing Figures

FLEXIBLE PERMEABLE VALVE FOR MELT SPINNING PROCESS

FIELD OF THE INVENTION

This invention relates to chill-cast metal foils. More particularly, this invention relates to an apparatus and method for producing continuous chill-cast metal foils.

BACKGROUND OF THE INVENTION

Chill-casting of metal foils is a process whereby a stream of molten metal is impinged upon a rapidly moving cooled surface which not only chill quenches a layer of molten metal but translates this layer away from the impingement region to produce continuous foil.

These foils are generated by the flow of molten metal through a very fine orifice(s) or slot(s) which are easily plugged by particles in the molten metal such as an oxide particulate. A variety of metals and metal alloys form an oxide when exposed to air and this formation is accelerated when the metal is heated to a molten state. The oxide formation can inhibit the flow of the molten metal during the melt spinning process by partially or completely blocking the reservoir orifice. Therefore, it is important to prevent air from coming in contact with the molten metal to prevent an oxide formation.

One of the conventional methods for preventing oxidation uses a purging gas stream that flows around the metal charge inside the reservoir (e.g. crucible) prior to the melting step as well as flushing a purge gas around the reservoir orifice externally. This approach suffers severe limitations.

In order to prevent the molten metal from prematurely flowing through the orifice of the reservoir, the purging gas stream must be shut off prior to melting the metal charge, and depending upon the diameter of the orifice a slight negative pressure may have to be applied to the reservoir to prevent the metal once melted from flowing through the orifice. An external application of purge gas is not very effective to prevent oxidation of the molten metal since during the melt spinning process the chill wheel rotates at very high speeds, typically 3000 ft/min, which generates a very strong air boundary layer on the surface of the wheel and forces air into the external purging gas shroud and into the orifice thereby exposing the molten metal to air prior to the initiation of the molten metal flow. This exposure can cause oxidation of the molten metal and a formation of particulates which are detrimental to high quality foil processing. Because of these problems, many oxidation prone materials are processed inside isolation chambers where air could be completely eliminated. However, this approach does not lend itself to larger scale production operations.

A new and improved apparatus and method were developed to minimize these problems.

SUMMARY OF THE INVENTION

It is an object of the present invention to provide an improved apparatus and method for minimizing the exposure of a molten metal to air prior to the processing of a chill-cast metal foil.

In accordance with one aspect of the present invention, there is provided an improved apparatus for producing a chill-cast metal foil. The apparatus comprises a chill wheel having a chill surface, a reservoir for holding molten metal, a heater for maintaining the molten metal above its melting point in the reservoir, the reservoir having an orifice to direct the molten metal on the chill surface, and a gas permeable molten metal retaining device for retaining the molten metal in the reservoir and for effecting a non-oxidizing gas purging of the reservoir containing the molten metal and the orifice prior to the processing of the chill-cast metal foil. The apparatus also has a reservoir pressure control device for effecting an expulsion of the molten metal in the reservoir through the orifice onto the chill surface of the chill wheel to form a chill-cast metal foil.

According to another aspect of the present invention, there is provided an improved method for producing a chill-cast metal foil. The method comprises adding metal to be processed into the reservoir of the melt spinning apparatus. The reservoir containing the metal and the orifice in the reservoir are purged with a non-oxidizing purge gas to remove any oxidizing atmosphere. The purging of the reservoir containing the metal and the orifice is maintained while applying sufficient energy to melt the metal in the reservoir. The gas permeable molten metal valve covering the orifice in the reservoir is removed to enable the molten metal to flow through the orifice onto the chill surface of the chill wheel to form a chill-cast foil of the metal.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Figure 1:
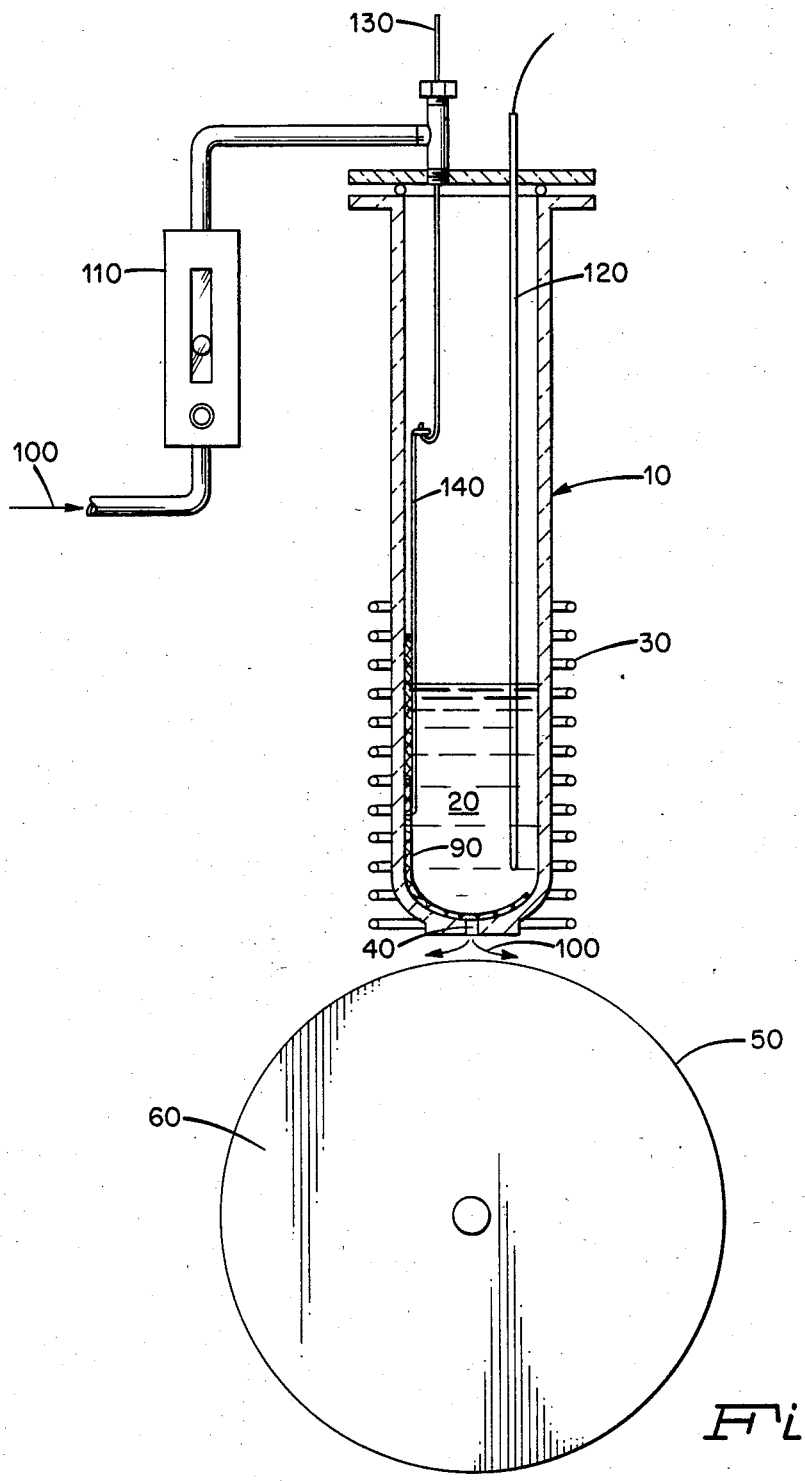
FIG. 1 is a diagrammatic representation of an apparatus of the present invention for producing chill-cast metal foil.

Referring now to the drawings with greater particularity, there is shown in FIG. 1 a diagrammatic representation of a reservoir 10 (e.g. crucible) for holding a molten metal (20 e.g., 24 w/o copper, 14.5 w/o indium, remainder silver). The molten metal is maintained at a temperature above its melting point by a heater 30 (e.g., resistance, induction, arc, laser, etc.) in the reservoir 10.

Figure 2:
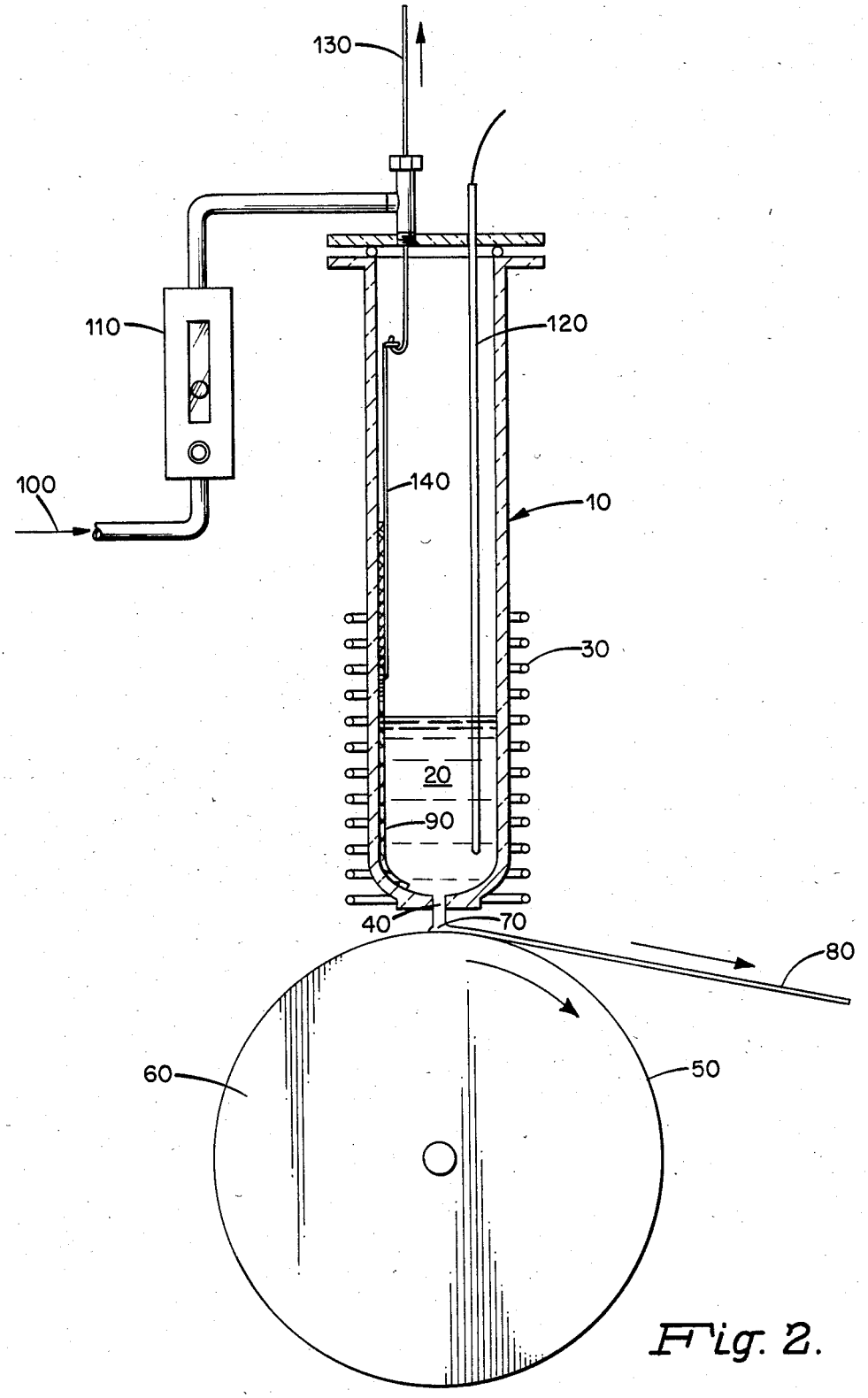
FIG. 2 is a diagrammatic representation of the apparatus in FIG. 1 after the gas permeable molten metal valve covering the orifice has been displaced to effect flow of the molten metal to form a chill-cast foil of the metal.

Shown in FIG. 2, reservoir 10 has an orifice 40 (e.g., a round opening or a slot) which delivers the molten metal 20 to a chill surface 50 of a chill wheel 60, (e.g., rotating water cooled chill wheel) to form a melt puddle 70 which solidifies to a chill-cast metal foil 80.

Shown in FIG. 1 a gas permeable molten metal retaining valve 90 is located over the orifice 40 to retain the molten metal 20 in reservoir 10. The valve 90 is made from a gas permeable flexible refractory sheet such as silica cloth which is flexible enough to conform to the contours of the inside surface of reservoir 10 and effectively cover the orifice 40 prior to processing of the chill-cast metal foil 80. The silica cloth is useable to temperatures greater than 1200° C. Valve 90 is permeable to a non-oxidizing purge gas 100 (e.g. forming gas, nitrogen, etc.) but not permeable to molten metal 20. A forming gas purge is used while heating to remove any surface oxides.

This feature of valve 90 permits the purging of orifice 40 even with molten metal 20 setting on top of valve 90 as illustrated in FIG. 2. This unusual and unexpected characteristic of retaining the molten metal 20 and simultaneously purging the reservoir 10 and the orifice 40 prevents any oxygen containing atmosphere such as air from contacting the molten metal 20 and forming undesirable oxide buildup within the orifice 40 which could partially or completely stop the flow of molten metal 20.

Any buildup of oxide can also reduce the quality of foil produced by disturbing the proper flow of the molten metal 20 through the orifice 40 or by oxide particles remaining within the finished chill-cast foil 80.

FIG. 2 illustrates the flow of molten metal 20 onto the chill surface 50 of the chill wheel 60 forming the chill-cast metal foil 80.

To make an improved chill-cast metal foil such as an alloy containing 24 w/o copper, 14.5 w/o indium and the remainder silver, a charge of the alloy is placed into the reservoir 10 on top of the valve 90. A non-oxidizing gas 100, such as a forming gas (5%$H_2$, 95%$N_2$), is purged into the reservoir 10 throughout the metal charge and through the orifice 40 to purge any oxidizing atmosphere out of the system and to remove any surface oxides. This purging of the non-oxidizing gas 100 is maintained while the metal charge is melted by heater 30 to form a molten metal 20. The valve 90 prevents the molten metal 20 from flowing into the orifice 40 and expelling out of the reservoir prematurely. Valve 90 also provides a path for the non-oxidizing gas 100 to flow from the reservoir 10 past the molten metal through the orifice 40 by maintaining the top of valve 90 above the level of molten metal 20 thereby assuring a continuous purging of the orifice 40 so no oxidizing atmosphere can enter into the orifice 40 and come into contact with molten metal 20 prior to the expulsion of the molten metal 20 onto the chill surface 50 to form chill-cast metal foil 80. The flow and pressure of the non-oxidizing purge gas 100 is controlled by a pressure controlled flow meter 110. The flow of the molten metal 20 can be controlled by either a pressure controlled flow meter 110 or by a separate pressure control by controlling the amount of overpressure maintained in the reservoir 10.

Once the metal is melted and the molten metal 20 is maintained at the required temperature as determined by the read out of the thermocouple 120, the chill wheel 60 is rotated at a prescribed r.p.m. and the valve 90 is removed from the orifice 40 by pulling up on the control wire 130 which is attached to valve 90 by valve wire 140. Once valve 90 is removed from the orifice 40 the molten metal 20 is free to flow through orifice 40 aided by the pressure of the purge gas 100 stil flowing into the reservoir 10 but no longer through orifice 40 or by a well-regulated over pressure of the purge gas 100 in the reservoir 10 or by the head pressure of the molten metal 20.

EXAMPLE 1

Alloy—24 w/o copper, 14.5 w/o indium, remainder silver
Charge—450 g
Orifice opening—11 mm×0.5 mm
Orifice to chill surface distance—0.15 mm
Purge gas—5%$H_2$ and 95%$N_2$
Purge gas flow rate—0.3 liters/min initial purge for 10 min followed by 0.03 liters/min prior to processing
Alloy melt temperature—900° C.
Overpressure gas—5%$H_2$ and 95%$N_2$
Melt overpressure—20.7 KN/$M^2$
Chill wheel (copper) diameter—20 cm
Chill wheel speed—1,500 rpm
Flexible gas permeable value—15 cm×2.5 cm Refrasil 90% silica cloth, Hitco, Mat Division, Armco Inc. 15 cm×2.5 cm
Foil dimensions—width—10.7 mm; thickness—0.025 mm

EXAMPLE 2

Alloy—12 w/o germanium, 0.25 w/o nickel, remainder copper
Charge—450 g
Orifice opening—9.0 mm×0.76 mm
Orifice to chill surface distance—0.28 mm
Purge gas—5%$H_2$ and 95%$N_2$
Purge gas flow rate—0.3 liters/min initial purge for 10 min followed by 0.03 liters/min prior to processing
Alloy melt temperature—1025° C.
Overpressure gas—5%$H_2$ and 95%$N_2$
Melt overpressure—6.9 kN/$M^2$
Chill wheel (copper) diameter—20 cm
Chill wheel speed—1350 rpm
Flexible gas permeable valve—15 cm×2.5 cm Refrasil 90% silica cloth, Hitco, Mat Division, Armco Inc.
Foil dimension—width—8.6 mm; thickness—0.06 mm While there has been shown and described what are at present considered the preferred embodiments of the invention, it will be obvious to those skilled in the art that various changes and modifications may be made therein without departing from the scope of the invention as defined by the appended claims.

What is claimed is:

1. Apparatus for producing chill-cast metal foil comprising a chill wheel having a chill surface;

a reservoir for holding molten metal, said reservoir having an inside surface and having an orifice for directing the molten metal upon said chill surface;

heating means for maintaining the molten metal above its melting point in said reservoir;

gas permeable molten metal retaining means for retaining the molten metal in said reservoir and for effecting a purging of said orifice with a non-oxidizing purging gas, said gas permeable molten metal retaining means being flexible and conforming to said inside surface of said reservoir, said gas permeable molten metal retaining means being adapted to move to a position covering said orifice or to a position uncovering said orifice; and means for effecting expulsion of the molten metal contained in said reservoir through said orifice onto said chill surface of said chill wheel to form a chill-cast metal foil.

2. Apparatus in accordance with claim 1 wherein chill wheel is a rotating chill wheel.

3. Apparatus in accordance with claim 1 wherein said means for effecting expulsion of said molten metal contained in said reservoir through said orifice for impinging on said chill surface is a pressurized gas controlled by a flow meter.

4. Apparatus in accordance with claim 1 wherein said gas permeable molten metal retaining means is a gas permeable flexible refractory sheet.

5. Apparatus in accordance with claim 4 wherein said gas permeable flexible refractory sheet is a silica cloth.

6. A method for producing a chill-cast metal foil comprising adding a charge of metal into an apparatus for producting chill-cast metal foil; said apparatus comprising a chill wheel having a chill surface;

a reservoir for holding molten metal, said reservoir having an inside surface and having an orifice for directing the molten metal upon said chill surface;

heating means for maintaining the molten metal above its melting point in said reservoir;

gas permeable molten metal retaining means for retaining the molten metal in said reservoir and for effecting a purging of said orifice with a non-oxidizing purging gas, said gas permeable molten metal retaining means being flexible and conforming to said inside surface of said reservoir, said gas permeable molten metal retaining means being adapted to move to a position covering said orifice or to a position uncovering said orifice; and means for effecting expulsion of the molten metal contained in said reservoir through said orifice onto said chill surface of said chill body;

purging said reservoir, said metal, and said orifice with a non-oxidizing purging gas;

heating said metal in said reservoir to form a molten metal;

purging of said reservoir and said orifice with said non-oxidizing purging gas, the purging of said orifice occurring by passage of purging gas from the resevoir to the orifice through the gas permeable retaining means; and removing said gas permeable molten metal retaining means from said orifice effecting a flow of the molten metal through said orifice and impinging of the molten metal on said chill surface of said chill wheel forming a chill-cast metal foil.

* * * * *